US007767837B2

(12) United States Patent
Elliott

(10) Patent No.: US 7,767,837 B2
(45) Date of Patent: Aug. 3, 2010

(54) METHODS OF MAKING ALKYL ESTERS

(75) Inventor: Brian Elliott, Wheat Ridge, CO (US)

(73) Assignee: TDA Research, Inc., Wheat Ridge, CO (US)

( * ) Notice: Subject to any disclaimer, the term of this patent is extended or adjusted under 35 U.S.C. 154(b) by 0 days.

(21) Appl. No.: 11/744,693

(22) Filed: May 4, 2007

(65) Prior Publication Data

US 2008/0275260 A1 Nov. 6, 2008

(51) Int. Cl.
*C11B 1/00* (2006.01)

(52) U.S. Cl. ..... 554/167; 554/160; 554/174

(58) Field of Classification Search ..... 554/124, 554/169, 160, 167, 174
See application file for complete search history.

(56) References Cited

U.S. PATENT DOCUMENTS

| | | | | |
|---|---|---|---|---|
| 1,967,319 | A | 7/1934 | Moore | |
| 2,400,607 | A * | 5/1946 | Segessemann | 530/207 |
| 4,698,186 | A | 10/1987 | Jeromin et al. | |
| 5,525,126 | A | 6/1996 | Basu et al. | |
| 5,713,965 | A | 2/1998 | Foglia et al. | |
| 5,908,946 | A | 6/1999 | Stern et al. | |
| 6,147,196 | A | 11/2000 | Stern et al. | |
| 6,399,800 | B1 | 6/2002 | Haas et al. | |
| 6,712,867 | B1 | 3/2004 | Boocock | |
| 6,768,015 | B1 | 7/2004 | Luxem et al. | |
| 6,855,838 | B2 | 2/2005 | Haas et al. | |
| 6,887,283 | B1 | 5/2005 | Ginosar et al. | |
| 6,965,044 | B1 | 11/2005 | Hammond et al. | |
| 7,090,788 | B2 | 8/2006 | Elliott | |
| 7,122,688 | B2 | 10/2006 | Lin et al. | |
| 7,211,681 | B2 * | 5/2007 | Furuta | 554/174 |
| 2003/0158074 | A1 | 8/2003 | Haas et al. | |
| 2004/0034244 | A1 | 2/2004 | Bournay et al. | |
| 2005/0107624 | A1 | 5/2005 | Lin et al. | |
| 2006/0069274 | A1 | 3/2006 | Dias De Moraes E Silva et al. | |
| 2006/0293533 | A1 | 12/2006 | Iyer | |
| 2007/0260077 | A1 | 11/2007 | Elliott | |

FOREIGN PATENT DOCUMENTS

| | | | |
|---|---|---|---|
| WO | WO 81/00846 | * | 4/1981 |

OTHER PUBLICATIONS

CHoi, J.K., Preparation method of Fatty Acid Ester Using Metal Oxides Catalyst, 2002, KR20020028120 (abstract espace).*

(Continued)

*Primary Examiner*—Daniel M Sullivan
*Assistant Examiner*—Yate' K Cutliff
(74) *Attorney, Agent, or Firm*—Greenlee, Winner and Sullivan, P.C.

(57) ABSTRACT

A method comprising contacting an alcohol, a feed comprising one or more glycerides and equal to or greater than 2 wt % of one or more free fatty acids, and a solid acid catalyst, a nanostructured polymer catalyst, or a sulfated zirconia catalyst in one or more reactors, and recovering from the one or more reactors an effluent comprising equal to or greater than about 75 wt % alkyl ester and equal to or less than about 5 wt % glyceride.

46 Claims, 4 Drawing Sheets

OTHER PUBLICATIONS

Kiss, A.A. et al., Solid Acid Catalyst for Biodiesel Prodiction—Towards Sustainable Energy, Jan. 2006, Advanced synthesis & Catalysis, vol. 348, pp. 75-81.*

Mbaraka, I. et al., Conversion of Oils and Fats using Advanced Mesoporous Heterogeneous Catalysts, Feb. 2006, Journal of American Oil Chemists' Society, vol. 83, No. 2, pp. 79-91.*

Pouilloux, Y. et al., Reaction of Glycerol with fatty acids in the presence of ion-exchange resins preparation of monoglycerides, 1999, Journal of Molecular Catalysis A: Chemical, vol. 149, pp. 243-254.*

Xu et al., heterogeneous Catalysis Unsing a Nanostructured solid Acid Resin Based on Lyotropic Liquid Crystals, 2004, J.Am.Chem. Soc., vol. 126, No. 6, pp. 1616-1617.*

Canakci, M., et al., "Biodiesel Production Via Acid Catalysis," Transactions of the ASAE, 1999, pp. 1203-1210, vol. 42, No. 5, American Society of Agricultural Engineers.

Kiss, A., et al., Solid Acid Catalysts for Biodiesel Production—Towards Sustainable Energy; Adv. Synth. Cata, 2006, vol. 348, pp. 75-81.

Standard Test Method for Acid Value of Fatty Acids and Polymerized Fatty Acids; Designation: D 1980-87 (Reapproved 1998); American Society for Testing and Materials.

Xu, Yanjie, et al., "Catalyzed Dioctyl Phthalate Formation Using a Nanostructured Solid Acid Resin," AlChE Journal, Jan. 2005, pp. 418-421, vol. 52, No. 1, American Institute of Chemical Engineers.

Xu, Yanjie, et al., "Heterogeneous Catalysis Using a Nanostructured Solid Acid Resin Based on Lyotropic Liquid Crystals," J. Am. Chem. Soc., Communications, 2004, pp. 1616-1617, vol. 126, No. 6, American Chemical Society.

Office Action issued in U.S. Appl. No. 11/381,924, Jan. 27, 2009.

Response to Non-final Office Action in U.S. Appl. No. 11/381,924 filed Aug. 25, 2008.

Abreu et al. (2005, avail. online Dec. 2004) "New multi-phase catalytic systems based on tin compounds active for vegetable oil transesterification reaction," *J. Molecular Catalysis A: Chemical* 227:263-267.

Furuta et al. (2004) "Biodiesel fuel production with solid superacid catalysis in fixed bed reactor under atmospheric pressure," *Catalysis Comm*. 5:721-723.

Jitputti et al. (Feb. 2006) "Transesterification of crude palm kernel oil and crude coconut oil by different solid acid catalysts," *Chemical Engineering J.* 116:61-66.

Karmee et al. (Feb. 2005) "Preparation of biodiesel from crude oil of *Pongamia pinnata," Bioresource Technology* 96:1425-1429.

Kiss et al. (Nov. 2006) "The heterogeneous advantage: biodiesel by catalytic reactive distillation," *Topics Catalysis* 40(1-4):141-150.

Lopez et al. (Sep. 2005) "Transesterification of triacetin with methanol on solid acid and base catalysts," *Applied Catalysis A: General* 295:97-105.

Lotero et al. (Jan. 2005) "Synthesis of Biodiesel via Acid Catalysis," *Ind. Eng. Chem. Res*. 44:5353-5363.

Mbaraka et al. (2003) "Organosulfonic acid-functionalized mesoporous silicas for the esterification of fatty acid," *J. Catalysis* 219:329-336.

Sreeprasanth et al. (Sep. 2006) "Hydrophobic, solid acid catalysts for production of biofuels and lubricants," *Applied Catalysis A: General* 314:148-159.

Takagaki et al. (Jun. 2006) "Esterification of higher fatty acids by a novel strong solid acid," *Catalysis Today* 116:157-161.

Tesser et al. (Sep. 2005) "Kinetics of Oleic Acid Esterification with Methanol in the Presence of Triglycerides," *Ind. Eng. Chem. Res*. 44:7978-7982.

Toda et al. (Nov. 2005) "Biodiesel made with sugar catalyst," *Nature* 438:178.

Response to Office Action in U.S. Appl. No. 11/381,924, filed Mar. 4, 2009.

Office Action U.S. Appl. No. 11/381,924 issued Feb. 2008.

M.A. Ecormier et al. (2003) "Structure-reactivity correlations in sulphated-zirconia catalysts for the isomerization of α-pinene" J. of Catalysis 215:57-65.

Notice of Allowance issued in U.S. Appl. No. 11/381,924 mailed Dec. 7, 2009.

Office Action issued in U.S. Appl. No. 11/381,924 on Apr. 30, 2009.

* cited by examiner

4A

4B

METHODS OF MAKING ALKYL ESTERS

STATEMENT REGARDING FEDERALLY SPONSORED RESEARCH OR DEVELOPMENT

The embodiments described in this disclosure were made, at least in part, with funding from the Department of Energy Contract No. DE-FG02-04ER86169, U.S. Department of Agriculture Contract No. 2006-33610-16838, and Environmental Protection Agency Contract No. EP-D-07-058. Accordingly, the U.S. government may have certain rights in the subject matter disclosed herein.

CROSS-REFERENCE TO RELATED APPLICATIONS

The subject matter of the present application is related to U.S. patent application Ser. No. 11/381,924 entitled "Method of Making Alkyl Esters" filed on May 5, 2006 and incorporated by reference herein in its entirety for all purposes.

FIELD OF THE INVENTION

This disclosure relates generally to the field of alkyl esters. More particularly, this disclosure relates to a method of converting low-cost feedstocks into alkyl esters that may be used as fuels.

BACKGROUND OF THE INVENTION

Alkyl esters, including methyl ester, ethyl ester, propyl ester, butyl ester, and/or pentyl ester also known as biodiesel, are a renewable and clean burning alternative to conventional petroleum-derived diesel fuel. Biodiesel is made from a raw or used vegetable oil or animal fat, which is converted to the corresponding alkyl esters. Because biodiesel is made from natural oil or fat sources (i.e., natural source oils), the alkyl esters typically comprise $C_{14}$ to $C_{18}$ fatty chains if derived from vegetable oil, and $C_{16}$ to $C_{22}$ fatty chains if derived from animal fat. Biodiesel can be combusted in diesel (combustion-ignition) engines either in pure form or as blended with petroleum-derived diesel fuel. Biodiesel provides the benefits of a renewable resource as well as providing lower sulfur emissions than petroleum diesel. Biodiesel is effectively a zero-sulfur emission fuel.

The cost of feedstock for the production of biodiesel varies depending on the composition of the feedstock and may be a significant contribution to the final cost of the fuel product. Hence, it would be desirable to use lower-cost oil feedstocks that contain higher levels of free fatty acid and reduce the overall costs associated with the production of biodiesel. However, alkyl esters are commonly made by processes that require highly refined vegetable oils. For example, one process for the production of biodiesel employs the base-catalyzed transesterification of triglycerides with an alcohol such as methanol. In this process, a homogeneous catalyst (i.e., one that dissolves into the feedstock mixture) is used. Base-catalyzed transesterification when compared to acid-catalyzed transesterification typically has a higher reaction rate for converting a glyceride composition to alkyl esters. Unfortunately, these base-catalyzed transesterification processes cannot typically tolerate high levels of free fatty acid because of the soap by-product which is produced. The formation of a soap by-product may complicate product recovery efforts and purification and irreversibly consume a portion of the catalyst. Therefore, base-catalyzed transesterification processes typically require a highly refined natural source oil feedstock that is considerably more expensive than lower grade unrefined oil feedstocks.

Consequently, there remains a need in the art for methods of making alkyl esters using lower-cost feedstocks comprising a high free fatty acid content.

BRIEF SUMMARY

Disclosed herein is a method comprising contacting an alcohol, a feed comprising one or more glycerides and equal to or greater than 2 wt % of one or more free fatty acids, and a solid acid catalyst in one or more reactors, and recovering from the one or more reactors an effluent comprising equal to or greater than about 75 wt % alkyl ester and equal to or less than about 5 wt % glyceride.

Also disclosed herein is a method comprising contacting an alcohol, a feed comprising one or more glycerides and equal to or greater than 2 wt % of one or more free fatty acids, and a nanostructured polymer catalyst in one or more reactors, and recovering from the one or more reactors an effluent comprising equal to or greater than about 75 wt % alkyl ester and equal to or less than about 5 wt % glyceride.

Further disclosed herein is a method comprising contacting an alcohol, a feed comprising one or more glycerides and equal to or greater than 2 wt % of one or more free fatty acids, and a sulfated zirconia catalyst in one or more reactors, and recovering from the one or more reactors an effluent comprising equal to or greater than about 75 wt % alkyl ester and equal to or less than about 5 wt % glyceride.

BRIEF DESCRIPTION OF THE DRAWINGS

For a detailed description of the embodiments of the present disclosure, reference will now be made to the accompanying drawings in which.

The specific components (e.g., glycerides, free fatty acids, alcohols, catalysts, co-solvents, etc.) and amounts thereof in various process streams or steps shown in the Figures represent illustrative embodiments and results, and are not otherwise limiting of the general inventive concepts disclosed herein.

In an embodiment, a method for the production of alkyl esters comprises contacting in one or more reactors under reaction conditions a feed comprising one or more glycerides and one or more free fatty acids, one or more solid acid catalysts, one or more alcohols, optionally one or more co-solvents, and optionally water. The contacting of the reactants (e.g., glycerides, fatty acids, alcohol, water) in the presence of catalysts and reaction conditions as described herein may result in a number of concurrently occurring reactions that include but are not limited to transesterifications, direct esterifications and hydrolysis reactions. Herein transesterification reactions are given their ordinary meaning in the art as referring to the process of exchanging the alkoxy group of an ester compound (e.g., a glyceride such as triglyceride) by another alcohol, shown schematically in reaction 1.

$$\text{R—COOR'+R''—OH} \rightarrow \text{R—COOR''+R'—OH} \qquad \text{Reaction 1}$$

Herein direct esterification reactions are given their ordinary meaning in the art as referring to the process in which two chemicals, for example an acid (e.g., a free fatty acid) and an alcohol form an ester, shown schematically in reaction 2.

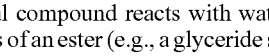

$$R—COOH+R'—OH \rightarrow R—COOR'+H_2O \quad \text{Reaction 2}$$

Herein a hydrolysis reaction is given its ordinary meaning in the art as referring to a chemical reaction or process in which a chemical compound reacts with water for example in the hydrolysis of an ester (e.g., a glyceride such as triglyceride) to form a carboxylic acid (e.g., a free fatty acid) and alcohol as shown in reaction 3.

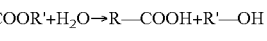

$$R—COOR'+H_2O \rightarrow R—COOH+R'—OH \quad \text{Reaction 3}$$

Figure 1:
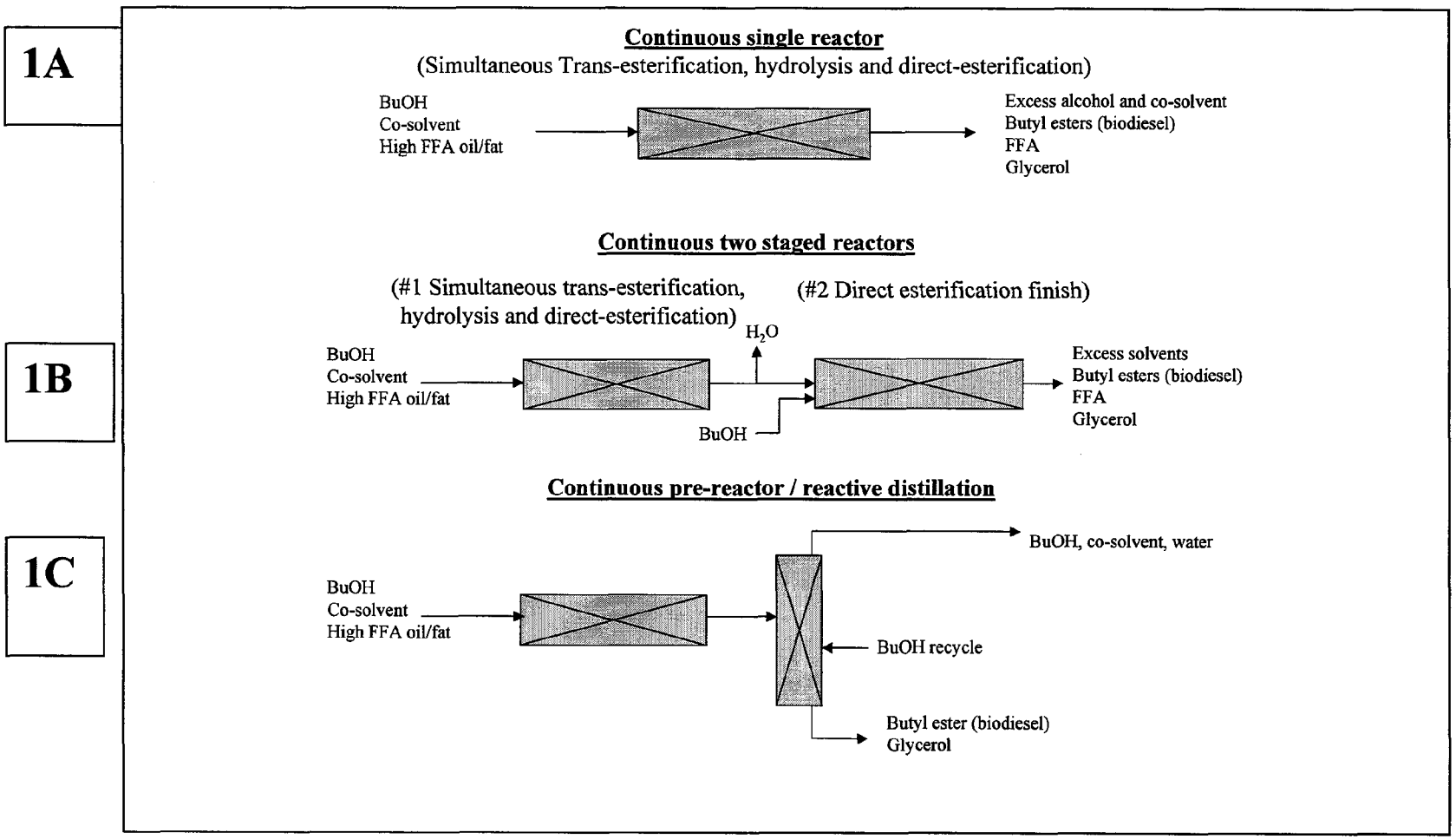
FIGS. 1A-1C are embodiments of the process of this disclosure.

An embodiment of a reaction of glycerides (e.g., triglyceride) and free fatty acid with an alcohol (e.g., 1-butanol (BtOH)) and a co-solvent (e.g., 1-butanone (MEK)) to produce an alkyl ester composition is shown in Scheme 1 and diagrammed schematically in FIG. 1 A:

Scheme 1

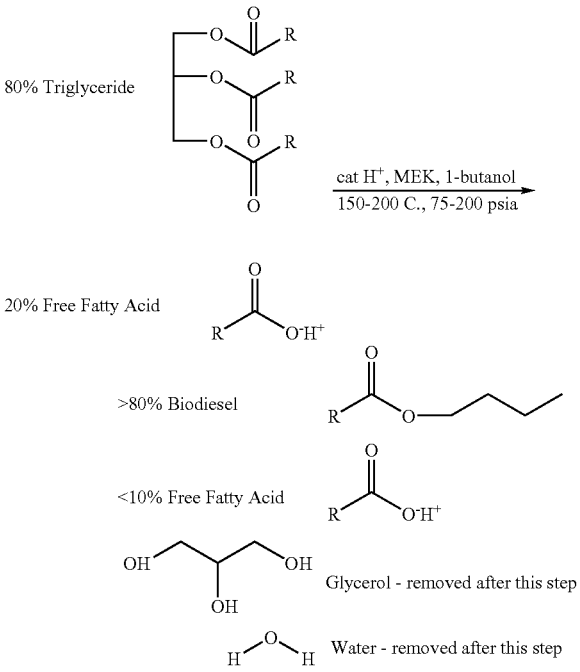

Referring to FIG. 1A, in an embodiment, a method employing a continuous single reactor may be used to convert a glyceride source (e.g., a natural source oil or fat) having a high free fatty acid content in the presence of an alcohol (e.g., BtOH) and a co-solvent (e.g., MEK) to form a product mixture comprising unreacted excess alcohol, butyl esters, free fatty acid and glycerol. Without wishing to be limited by theory, the process may involve simultaneous trans-esterification reaction, direct esterification and hydrolysis of the glycerides (e.g., triglyceride) in the reaction mixture to generate a product mixture which may be used as prepared or may be further processed as will be described later herein.

Referring to FIG. 1A, the method may be carried out at elevated temperatures and pressures within the reactor such as are compatible with the reaction components (e.g. reagents, catalysts, etc. . . . ). The reaction may be carried out in a temperature range of from about 100° C. to about 220° C., alternatively from about 125° C. to about 220° C., alternatively from about 150° C. to about 200° C., alternatively from about 175° C. to about 200° C., alternatively from about 140° C. to about 180° C., alternatively from about 145° C. to about 175° C., alternatively from about 145° C. to about 155° C., alternatively about 150° C. The reaction may be carried out at the minimum pressure required to maintain the reaction components (e.g., alcohol) in the liquid state. Alternatively, the reaction may be carried out at a pressure of from about 75 psia to about 200 psia, alternatively from about 75 psia to about 150 psia, alternatively from about 75 psia to about 100 psia. The reaction may be carried out at a residence time in the catalytic reactor from about 1 minute up to about 10 hours. Alternatively, the reaction may be carried out at a residence time in the catalytic reactor from about 5 minutes up to 5 hours, alternatively from about 30 minutes up to about 4 hours, alternatively from about 2 hours to about 4 hours, alternatively about 4 hours.

In an embodiment, at least a portion of the reactant mixture in the reactor, at least a portion of the effluent from the reactor (also referred to as a product mixture) or combinations thereof may be subjected to at least one analytical technique. For example, the product mixture may be subjected to analysis in order to characterize properties of the product mixture such as for example and without limitation the acid content of the product mixture and/or the composition of the product mixture. The number, type, scope and conditions of the product mixture analysis may be chosen and carried out by one of ordinary skill in the art. For example, the acidity of the product mixture may be determined in accordance with ASTM method D 1980-87 and the concentration and identity of individual components of the product mixture determined or hypothesized using chromatographic techniques such as gas chromatography.

The effluent from the reactor may comprise excess solvent, an alkyl ester enriched product when compared to the alkyl ester content of the reaction mixture and, a reduced free fatty acid content when compared to the reaction mixture free fatty acid content. In an embodiment, the reaction effluent or product mixture comprises equal to or greater than about 75% alkyl ester by mass, alternatively equal to or greater than about 80%, alternatively equal to or greater than about 83%. In embodiments, the product mixture may comprise equal to or less than about 5% glycerides by mass, alternatively equal to or less than about 4%, alternatively equal to or less than about 3%, alternatively equal to or less than about 2%, alternatively equal to or less than about 1%, alternatively equal to or less than about 0.5%, alternatively equal to or less than about 0.1%. In embodiments, the product mixture may comprise equal to or less than about 15% free fatty acid by mass, alternatively equal to or less than about 10%, alternatively equal to or less than about 8%. In embodiments, the product mixture may comprise equal to or less than about 10% glycerin by mass, alternatively equal to or less than about 8%, alternatively equal to or less than about 6%.

The reaction (e.g., reaction scheme 1) may be carried out in one or more reactors suitable for use in the processes disclosed herein. For example, the reactor may be a fixed bed reactor, a packed bed reactor, a reactive distillation column, a slurry reactor, or combinations thereof, each comprising a solid acid catalyst. In some embodiments, the reaction may be carried out in a plurality of reactors located downstream of one or more reactant feed tanks. In such embodiments, the plurality of reactors may be in fluid communication such that the effluent from one reactor may be conveyed to a downstream reactor for further processing. In an embodiment, the reaction (e.g., reaction scheme 1) is carried out in a plurality of reactors in series and/or parallel, wherein water may be removed between reactors in series. In an embodiment, FIG. 1A the continuous single reactor is replaced or supplemented with a plurality of reactors carrying out the reactions.

In various embodiments, reactor systems such as those shown in the Figures may contain multiple reactor vessels and additional devices, piping, instrumentation, and the like as known to one of ordinary skill in the art for the efficient production of a product mixture of the type disclosed herein and for the generation of reaction conditions conducive to the processes as described herein. Such devices may include, for example and without limitation, heating jackets, waste containers, release valves, bypass valves, sampling valves, sensors, control loops, and the like. Additionally, the methods described herein may be carried out manually, may be automated, or may be combinations of manual and automated processes. In an embodiment, the devices described herein may be controlled manually, may be automated or combinations thereof.

The feed may comprise one or more lipids such as triglycerides or fats. Such lipids may be derived from or obtained from a natural lipid source. In an embodiment, the feed comprises one or more glycerides and one or more free fatty acids. Free fatty acid refers to fatty acid molecules that are not bound to another compound. Free fatty acids may occur naturally or may result from cleavage of fatty acids from compounds such as glycerides, for example during heating (e.g., cooking or rendering processes). In an embodiment, the feed has a high free fatty acid content. In embodiments, the amount of free fatty acids present in the feed may be equal to or greater than about 2, 5, 10, 15, 20, 25, 30, 35, 40, 45, 50, 55, 60, 65, 70, 75, 80, 85, 90, 95, 99 or about 100 weight percent.

The feed may comprise glycerides having one ester linkage; two ester linkages, three ester linkages, or combinations thereof. Such glycerides are known as mono-, di-, tri-, and mixed glycerides, respectively. In an embodiment, the glyceride source may comprise glycerides having greater than three ester linkages. In some embodiments, the glyceride source comprises a mixture of glycerides such as for example a mixture of mono-, di-, and tri-glycerides. Furthermore, it is to be understood that the feed may comprise additional components such as for example glycerin, unsaturated fatty acids including natural "cis" fats and oils as well as processed "trans" fats or oils as a result of hydrogenation.

The feed may comprise, for example and without limitation, natural source oils that may be derived from biological sources or processes. The feed may comprise natural source oils derived from at least one biological source; alternatively the feed may comprise natural source oils derived from multiple biological sources. In an alternative embodiment, the feed comprises a blend of synthetic oils and natural source oils. Examples of synthetic oils include without limitation trioleine, mono-and tripalmitine, tristearol, glycerol onooleate and the like.

Herein, natural source oil refers to fats and/or oils obtained, by any method, from fruits, nuts, vegetables, plants and/or animals. Natural source oils further include fats and/or oils derived from genetically modified biological sources such as for example genetically-engineered plants or animals. The natural source oil my comprise glycerides as described herein (e.g., mono-, di-, and tri-glycerides). Furthermore, the natural source oil may comprise saturated or unsaturated fatty acid chains. These fatty acid chains are covalently bound to the glyceride molecule and differ from the free fatty acids previously described which are not covalently attached to the glyceride molecule. The natural source oils may be utilized in the disclosed processes as a raw, crude, or unprocessed products or may be high quality processed or refined oils.

In an embodiment, the natural source oil comprises one or more vegetable or nut oils. Such vegetable oils may be isolated from any vegetable or nut. Some non-limiting vegetable and nut oils include the oil from corn, soybeans, cuphea, peanut, radish, rice bran, rapeseed, olive, cottonseed, sunflower, sesame, safflower, mustard, palm, coconut, jatropha, linseed, caster, evening primrose, borage, carboseed or combinations thereof. Additional natural source oils that may be suitable for use in this disclosure include for example and without limitation false flax oil, hemp oil, ramtil oil, tung oil, copaiba oil, hong oil, colza oil, milk bush oil, petroleum nut oil or combinations thereof.

In an embodiment, the natural source oil may include oils derived from marine organisms such as algae or fish. In other embodiments, the natural source oil may include poultry fat, oils derived from a mammalian source such as lard or tallow, etc. The natural source oils may have fatty acid moieties ranging in length from $C_2$-$C_{24}$, and varying degrees of saturation.

In an embodiment, the natural source oil comprises a waste oil product. Waste oil products, for example spent frying oil, are naturally occurring oils recovered after having being utilized in a process such as cooking, rendering, etc. Such waste oils may be pretreated such as by filtering and later modified as described herein to produce an alkyl ester composition. In an embodiment, the natural oil source comprises yellow grease, brown grease, acidulated soap stock, meat rendering waste oil, virgin oil, degummed oil, once refined oil, or combinations thereof. Herein yellow grease refers to a natural source oil having a free fatty acid content of up to about 20%, while a brown grease refers to a natural source oil having a free fatty acid content of equal to or greater than about 20%. Furthermore, high quality yellow grease refers to a natural source oil having about 2 to about 5% free fatty acid while low quality yellow grease refers to a natural source oil having about 5 to about 20% free fatty acid. Acidulated soap stock is typically made by reacting soap by-product from the vegetable oil refining process with sulfuric acid, and is typically composed of over 70% free fatty acid.

In an embodiment, the catalyst is an acid catalyst, alternatively a solid acid catalyst. Solid acid catalysts in general are characterized by acid sites which are immobilized on a solid supporting material.

The solid acid catalyst may be any solid acid material that is compatible with the other components of the disclosed process, catalyzes the conversion of at least a portion of components of the feed to the corresponding alkyl ester, and affords a heterogeneous process for at least some portion of the reaction process. The solid acid catalyst may comprise acidic materials associated with a solid support, insoluble Lewis or Bronstead acids, or combinations thereof. In an embodiment, the solid acid catalyst comprises at least one polymeric ion-exchange resin, alternatively at least one fluorinated polymer resin with sulfonic acid sites, alternatively at least one nanostructured polymer acid catalyst, alternatively at least one inorganic acid catalyst, or alternatively combinations of two or more of the foregoing compounds.

In an embodiment, the solid acid catalyst comprises at least one polymeric ion-exchange resin. Examples of polymeric-ion exchange resins suitable for use in this disclosure includes without limitation the AMBERLYST series of polymeric catalysts and ion-exchange resins, for example AMBERLYST 15, AMBERLYST 131, AMBERLYST 16, AMBERLYST and AMBERLYST 36 commercially available from Rohm Haas. Additional examples of ion-exchange resins suitable for use in this disclosure include without limitation the DOWEX series of ion exchange resins commercially available from Dow Chemical Company. In an embodiment, the solid acid catalyst comprises at least one polymeric ion-exchange resin employed at a reaction temperature equal to or less than about 120° C.

In an embodiment, the solid acid catalyst comprises a fluorinated polymer resin. Such fluorinated polymer resins may be characterized by the presence of sulfonic acid sites and/or fluorinated sulfonic acid sites. A fluorinated polymer resin suitable for use in this disclosure includes for example and without limitation the NAFION series of polymers which are perfluorinated polymers that contain small proportions of sulfonic acid ionic functional groups commercially available from DuPont Chemical Company.

In an embodiment, the solid acid catalyst comprises a nanostructured polymer acid catalyst. Nanostructured polymer acid catalysts can be made by the methods described by Xu et al. in "Heterogeneous catalyst using a nanostructured strong acid resin based on lyotropic liquid crystals" published in 2004 in the *Journal of the American Chemical Society*, volume 126, pages 1616-1667 and incorporated by reference herein in its entirety. The use of these nanostructured solid acid catalysts for esterification reactions involving fatty acids is further described in U.S. patent application Ser. No. 11/381,924 entitled "Method of Making Alkyl Esters" filed on May 5, 2006 and incorporated by reference herein in its entirety. These nanostructured polymer catalysts may be made by polymerizing self-assembled lyotropic liquid crystalline acid surfactants. Various synthetic procedures not limited to those described by Xu et al. can be followed to synthesize the polymerizable surfactants and the catalyst themselves.

Nanostructured polymer catalysts can be further described as polymer materials comprising molecular ordering as a result of the self-assembly of polymerizable surfactants. Polymerizable surfactants include polymerizable lyotropic liquid crystals. Nanostructured polymer solid acid catalysts can be made by crosslinking a self-assembled collection of polymerizable surfactants that contain acidic groups such as sulfonic acids or other acids. Nanostructured polymers can comprise liquid crystalline structures including lamellar, hexagonal, inverse hexagonal, cubic, bicontinuous cubic and mixtures thereof. Nanostrucutred polymer catalyst can be made by forming a composite of polymerizable surfactants with other polymer materials as described in U.S. Pat. No. 7,090,788, which is incorporated by reference herein in its entirety.

In an embodiment, the solid acid catalyst comprises an inorganic acid catalyst. Inorganic acid catalysts include sulfated zirconia, tungstated zirconia, alumina, silica, zeolites or combinations thereof.

In an embodiment, the solid acid catalyst comprises a polymeric catalyst and the concentration of catalyst ranges from about 100 g/liter of internal reactor volume to about 3000 g/liter of internal reactor volume, alternatively from about 200 g/liter to about 500 g/liter. In an embodiment, the solid acid catalyst comprises an inorganic acid catalyst and the concentration of catalyst ranges from about 200 g/liter internal reactor volume to about 3000 g/liter internal reactor volume, alternatively from about 500 g/liter to about 2500/liter, alternatively from about 600 g/liter to about 2000 g/liter.

In some embodiments, the solid acid catalyst is ground and sieved into powders with an average diameter in the range of about 30 microns to about 60 microns. In some embodiments, the solid acid catalyst is an extrudate with a diameter of about ⅛ inch or about 3 mm, or 1/16 inch or about 1.5 mm, or other engineered shapes known in the art.

In an embodiment, the alcohol comprises a monoalcohol. In some embodiments, the alcohol has the general formula R—OH wherein R represents $C_n(H_{2n+1})$ and n is an integer ranging from 1 to 10. Examples of alcohols suitable for use include methanol, ethanol, n-propanoloxy (1-propanol), isopropanol (2-propanol), n-butanol (1-butanol), sec-butantol (2-butanol), isobutanol (2-methyl-1-propanol), tert-butanol (2-methyl-2-propanol), n-pentanol (1-pentanol), 2-pentanol, 3-pentanol, 2-methyl-1-butanol, tert-pentanol (2-methyl-2-butanol), 3-methyl-1-butanol, 3-methyl-2-butanol, neo-pentanol (2,2-dimethyl-1-propanol), 1-hexanol, 1-heptanol, 1-octanol, or combinations thereof. In some embodiments, the alcohol can be methanol, ethanol, propanol, butanol or combinations thereof.

In an embodiment, the alcohol is used in an excess amount, for example in an amount of from about 1.0 to about 10.0 excess equivalents, alternatively in an amount of from about 1.0 to about 4.0 equivalents excess. 4.0 equivalents of excess means that 5 moles of alcohol are reacted with 1 mole of ester bond equivalents in the triglyceride, diglyceride or monoglyceride (1 mole equivalent for the reaction and 4.0 mole equivalents excess). Triglycerides have 3 ester bonds, diglycerides have two ester bonds and monoglycerides have one ester bond.

In an embodiment, the co-solvent comprises a ketone, alternatively butanone. The cosolvent may function to promote the formation of a single liquid phase at either the storage and handling temperature and/or at the reaction temperature. It may dissolve fats that are solidified at handling temperatures or promote the formation of a single phase in the reactor when excess water is present. The amount of co-solvent in the reactor may range from about 5 wt % to about 75 wt %, alternatively from about 20 wt % to about 60 wt %, alternatively from about 50 wt % to about 60 wt %.

One or more components of the feed may be hydrolyzed in the presence of excess water. The water may be added in a ratio of about 5.0 moles of water to 1 mole of free fatty acid equivalent present in the feed. For example, one molecule of a triglyceride can produce 3 equivalents of free fatty acids; therefore 15 moles of water may be used per mole of triglyceride present in the feed. Alternatively, the water may be present in an amount of from about 1% to equal to or less than about 8% by mass of the feed to the reactor. Alternatively, the water may be present in an amount of from about 1% to equal to or less than about 4% by mass of the feed to the reactor.

In an embodiment, the product mixture (e.g., reactor effluent from FIG. 1A) may be used without further processing, alternatively, the product mixture may be subjected to further treatment such as for example, purification procedures. In some embodiments, the product mixture containing glycerin and other impurities may have at least a portion of the glycerin removed. In an embodiment, at least a portion of the glycerin may be removed from the product mixture using any technique known to one of ordinary skill in the art for the separation of at least a portion of the glycerin from the other components of the reaction mixture. For example, free fatty acids and alkyl esters can be purified by cooling the product mixture, allowing the glycerin to stratify, and separating the alkyl esters and free fatty acids from the heavier glycerin layer. Alternative methods such as continuous centrifugation are known by those skilled in the art.

In an embodiment, the product mixture is further processed by drying or dehydrating the mixture to remove water. Methods for the removal of water from the product mixture are known to one of ordinary skill in the art and may include for example and without limitation contacting the product mixture with water abating materials such as drying agents. Additional water removal methods known to those of ordinary skill in the art include use of a flash drum, distillation, molecular sieves, or combinations thereof.

Figure 2:
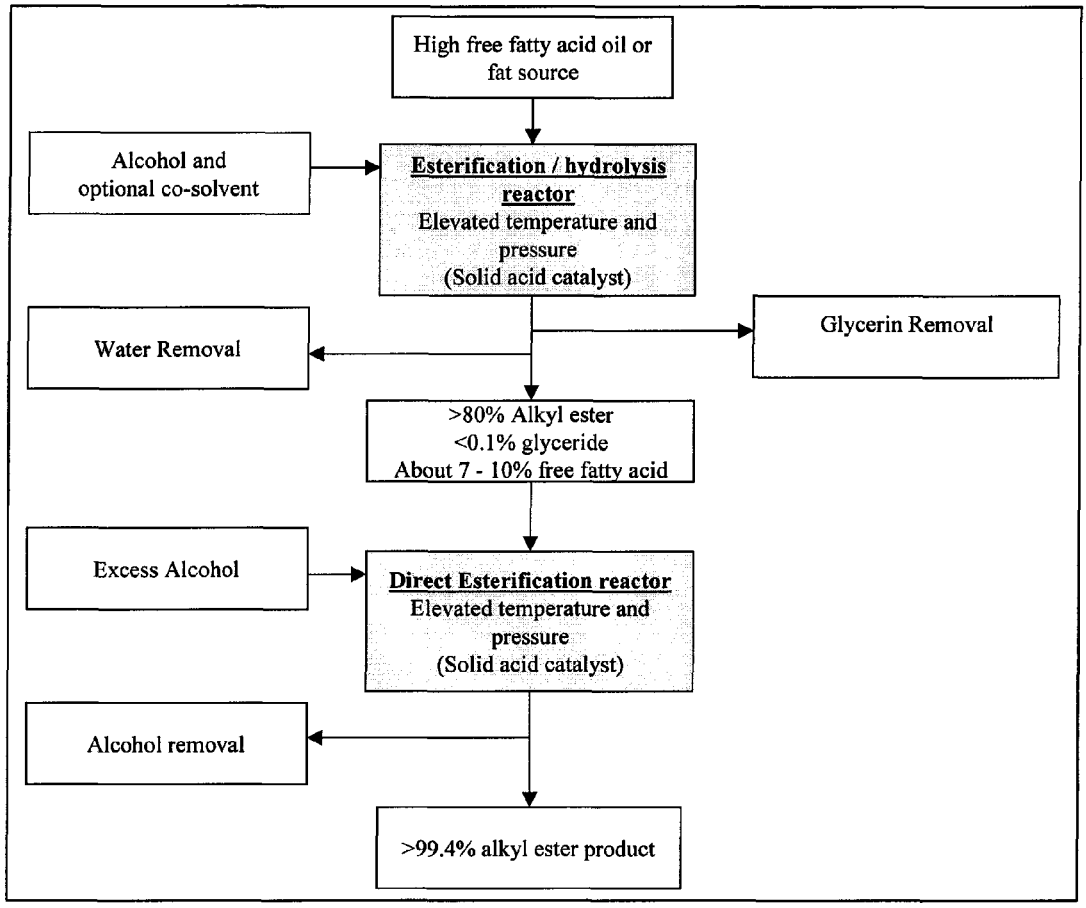
FIG. 2 is a process flow diagram for the production of alkyl esters.

Optionally, a product mixture produced in a first reactor or first combination of reactors (for example, as shown in FIG. 1A) may be further processed and/or reacted in a second reactor or second combination of reactors to increase the amount of alkyl esters in the mixture, for example as shown in the process flow diagram of FIG. 2. In an embodiment, a product mixture from a first reactor or first combination of reactors is optionally treated to remove glycerin and is dried to produce a dried product or effluent, which is then further processed by contact with an alcohol and a solid acid catalyst in a second reactor or second combination of reactors under second reaction conditions. Suitable alcohols and solid acid catalysts have been described previously herein. The solid acid catalyst and/or alcohol in the one or more second reactors may be the same as the solid acid catalyst and/or alcohol used in the one or more first reactors, may be different from the solid acid catalyst and/or alcohol used in the one or more first reactors, or may be a combination of a different solid acid catalyst and/or alcohol used together with the solid acid catalyst and/or alcohol used in the one or more first reactors. A reaction scheme illustrating a two step embodiment is shown in Scheme 2 and FIG. 1B:

Scheme 2

(Reactor #1)
simultaneous solid acid catalyzed hydrolysis and esterification

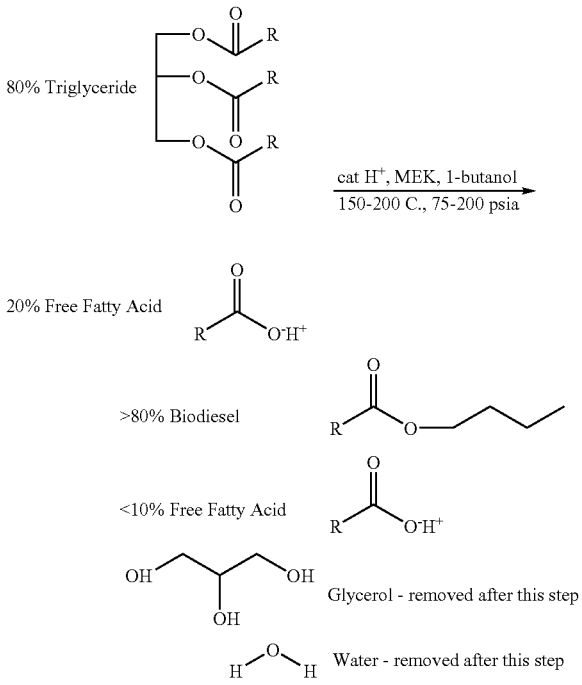

-continued
(Reactor #2)
solid acid catalyzed esterification

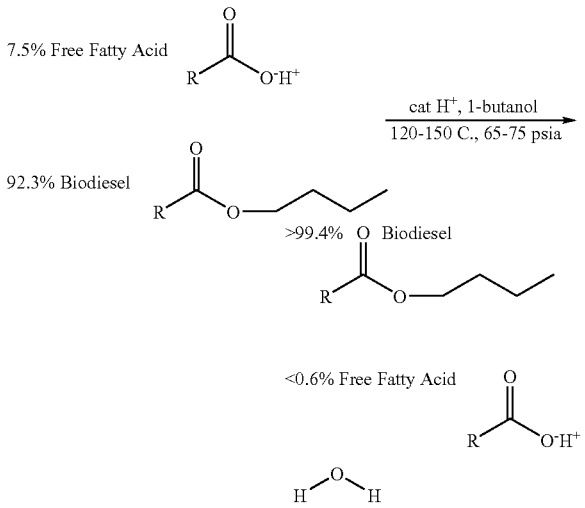

Referring to FIG. 1B, a two staged reactor (or two staged combination of reactors) may be employed. In a first reaction, a feed (e.g., a high free fatty acid content triglyceride), an alcohol (e.g., BtOH), and a co-solvent (MEK) are contacted in a first reactor or first combination of reactors with a first solid acid catalyst to form a first product mixture or reactor effluent. The process in the one or more first reactors may involve simultaneous transesterification, direct esterification and hydrolysis of the triglyceride in the reaction mixture to generate a product mixture which may then be treated to remove water (and optionally remove glycerin and/or co-solvent from the first reactor(s)) to produce a dried product mixture. The dried product mixture from the one or more first reactors may be fed along with an alcohol (e.g., BtOH) and optionally additional co-solvent (if needed) and contacted with a solid acid catalyst in a second reactor or second combination of reactors.

The reaction conditions in the one or more second reactors may comprise any combination of temperature and/or pressure compatible with the disclosed processes. For example, the reaction conditions in the one or more second reactors may be carried out at ambient pressure. Alternatively, the reaction conditions may comprise an elevated temperature, an elevated pressure, or both. In an embodiment, the temperature may range from about 80° C. to about 120° C., alternatively from about 100° C. to about 120° C., and the pressure may range from about 5 psia to about 100 psia, alternatively from about 14 psia to about 75 psia, alternatively at about 14.7 psia. The residence time of the product mixture in the reactor may be chosen by one of ordinary skill in the art to allow sufficient conversion of the free fatty acid. For example, residence time may range from about 20 minutes to about 6 hours, alternatively from about 30 minutes to about 4 hours, alternatively from about 2 hour to about 4 hours.

In an embodiment, at least a portion of second reaction mixture, at least a portion of second product mixture, or combinations thereof may be subjected to at least one analytical technique and/or processing step as described herein. The effluent from the second reactor, also referred to as a second product mixture, may comprise excess solvent, an enriched alkyl ester content when compared to the first product mixture, and a reduced free fatty acid content when compared to the reaction mixture or product mixture. In an embodiment, second product mixture, excluding any excess solvents and excluding any unremoved glycerin, may comprise from about 76% to about 100% alkyl esters, alternatively from about 90% to about 100% alkyl esters, alternatively from about 95% to about 100% alkyl ester. The second product mixture may be used without further processing, alternatively the second product mixture may be processed further such as for example by dehydration to effect removal of any residual water as has been described previously herein. In some embodiments, glycerin or excess solvents may be removed by further processing the second product mixture using processes such as solvent removal by flash drum, distillation, or other drying technique and/or glycerine removal by settling or stratifying followed by decanting, or by centrifugation including continuous centrifugation.

Esterification reactions such as the transesterification and direct esterification reactions described herein, are reversible and equilibrium limited. Conversion higher than the equilibrium at the initial composition can be achieved by using multiple, or "staged" reactors wherein all or part of the water from the effluent of one reactor is removed prior to additional processing in one or more additional reactors. These staged reaction techniques are known to those skilled in the art, and may be employed for the first and/or second reactors as described in various embodiments disclosed herein (e.g., FIG. 1B). In an embodiment, a method for producing an alkyl ester comprises contacting a feed (e.g., triglyceride having free fatty acids) with an alcohol, an optional co-solvent and a solid acid catalyst in an apparatus comprising multiple reactors wherein each reactor is operated under conditions of elevated temperatures and pressures. For example, the alkyl ester can be produced by a method in which a triglyceride may be reacted by conversion to near the equilibrium limit in a first packed-bed catalytic reactor, followed by removal of the reaction water, and then subsequently further reacted in one or more catalytic reactors in order to increase the percentage conversion of the triglyceride to the alkyl ester.

Alternatively, a method for the production of alkyl esters may comprise carrying out the reaction of a feed (e.g., triglyceride having free fatty acids) with an alcohol, an optional co-solvent utilizing a packed bed reactor comprising a solid acid catalyst, to afford a composition near the equilibrium limit, followed by catalytic reactive distillation. Catalytic reactive distillation is known by those skilled in the art, and comprises a distillation column with a reactive section that contains a solid acid catalyst. The process operates continually, with removal of reaction water and recycle of alcohol. Thus, conversions beyond the equilibrium limit (in the presence of water) can be reached. Alternatively, a catalytic reactive stripping column could be used. This is similar to a catalytic reactive distillation, but operates with the catalyst only in the stripping section of the column. Thus, the fatty acid and alkyl ester components of the feed are only traveling down the column in the liquid state.

Referring to FIG. 1C, a two staged reactor may be employed to convert a high free fatty acid content triglyceride in the presence of an alcohol (e.g., BtOH) and a co-solvent (e.g., MEK) to form a first product mixture. The process may involve simultaneous transesterification, direct esterification and hydrolysis of the triglyceride in the reaction mixture to generate the first product mixture, which may then be introduced to a catalytic reactive distillation reactor. The bottom effluent from the catalytic reactive distillation reactor, referred to as a second product mixture, may comprise an alkyl ester enriched product when compared to either the alkyl ester content of the first product mixture and a reduced free fatty acid content when compared to the first product mixture. Alcohol, co-solvent, and water may be recovered from an overhead stream, separated, and recycled to the process.

In an alternative embodiment, the feed (e.g., a triglyceride having one or more fatty acids) can be reacted in a batch reactor for a period of time to afford some conversion (e.g. 60%) to the alkyl ester and produce a first product mixture. The first product mixture having some portion of unreacted triglycerides and free fatty acids may be further converted to alkyl ester using either a continuous packed-bed reactor or a reactive distillation column comprising a solid acid catalyst. These processes are termed semi-continuous processes and are known by those skilled in the art. Alternatively, the processes disclosed herein may be carried out entirely in a reactive distillation column comprising one or more solid acid catalysts.

The methods disclosed herein may be carried out as continuous processes that result in a product having a high yield of alkyl esters with minor amounts of free fatty acid. The processes disclosed herein may tolerate a wide variety of low-cost feedstock materials containing high levels of free fatty acids that may not be desirable for use in other processes for producing alkyl esters (e.g., base-catalyzed processes) without significant pretreatment of the feedstock to reduce or remove the free fatty acids prior to transesterification. Free fatty acids are typically incompatible with processes that utilize alkaline catalysts as these processes allow for the conversion of the free fatty acids to soap which consumes the catalyst and complicates the recovery of the alkyl ester product from glycerin. The use of a solid acid catalyst in the processes disclosed herein may eliminate the need to neutralize the product stream and generate salt waste streams. Furthermore, the solid acid catalyst may provide a catalyst that retains catalytically active for a longer time period without regeneration when compared to other catalyst systems for the production of alkyl esters from triglycerides (e.g. homogenous acid catalysts). Lastly, the use of solid acid catalysts eliminates (e.g., catalyst fixed in a packed bed) or greatly simplifies (e.g., catalyst separated via a settling leg or vessel) separation of the catalyst from the reaction product.

EXAMPLES

To further illustrate various illustrative embodiments of the present disclosure, the following examples are provided. Compositional percentages are by mass (i.e., wt %) unless otherwise indicated.

Example 1

Example 1A

Figure 3:
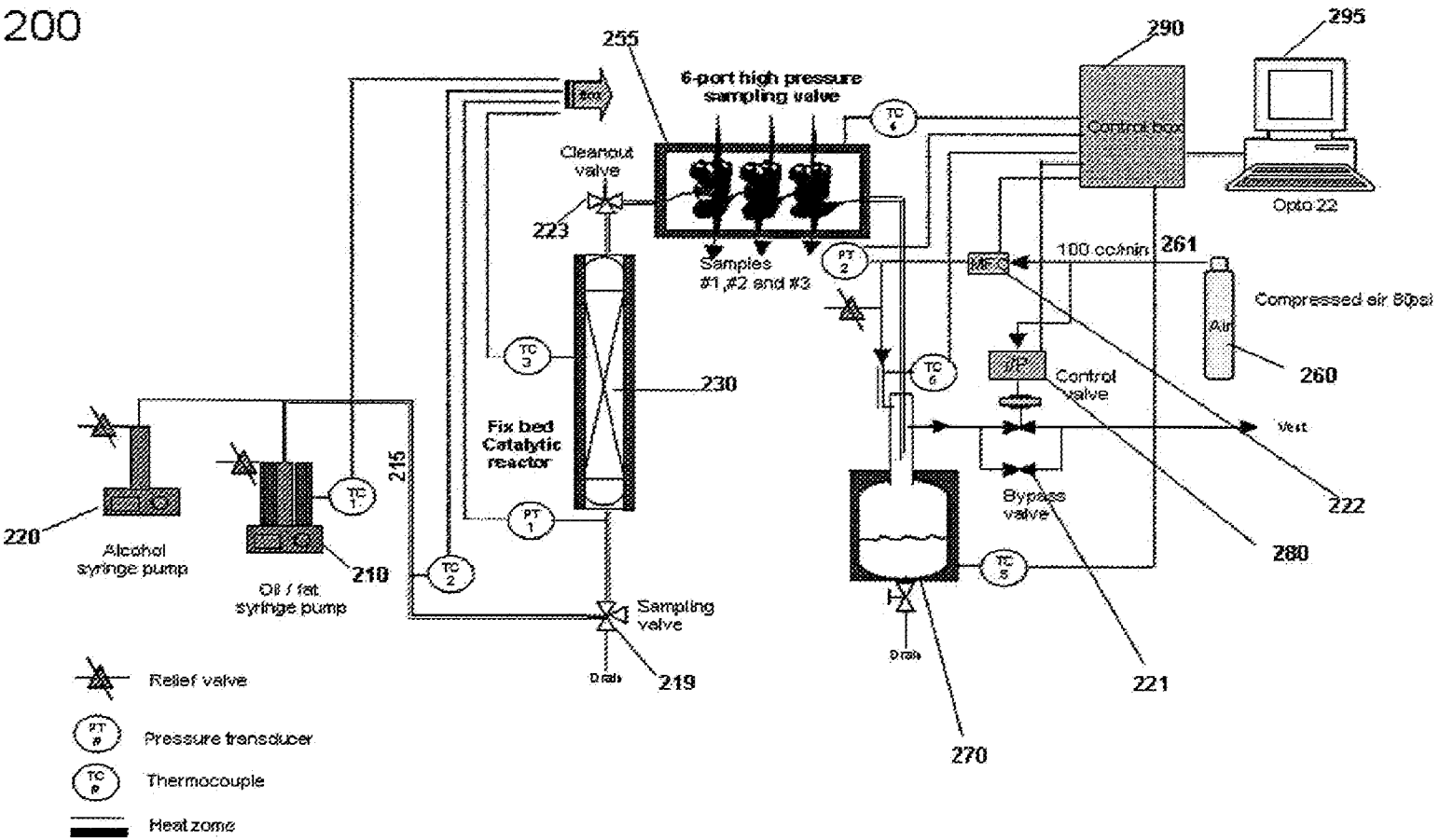
FIG. 3 is a schematic of embodiments of reactors for use in the production of alkyl esters.

An embodiment of a reactor 200 for use in the production of alkyl esters is shown schematically in FIG. 3. A high content free fatty acid feedstock was made by mixing 80% by mass soybean oil (Cargill) and 20% linoleic acid (Aldrich). This feedstock was loaded into a 260 cc syringe pump 210 (ISCO). A mixture of 66.7% 1-butanol and 33.3% MEK was loaded into a second 260 cc syringe pump 220. The two pumps feed the liquids via flow line 215 to a packed bed catalytic reactor 230 made from a hollowed out stainless steel rod with porous metal filters on each end to contain the solid catalyst. The flow rate for the oil feed was set to 6 μL/min and the solvent feed was set to 9 μL/min. Thus, the overall mixed feed contained 40% high fatty acid soybean oil, 40% 1-butanol, and 20% MEK. The reactor was packed with about 6 cc of sulfated zirconia pellets (⅛ in diameter pellets, as delivered with no thermal activation, from Saint Gobain). At this volumetric flow rate the residence time in the reactor was 4 hours. Resistive band heaters 240 on the outside of the stainless steel reactor 230 kept the reactor temperature controlled to 150° C. The exit of the reactor was plumbed into a collection vessel 270 that contained an applied pressure from compressed nitrogen 260 via flow line 261. A Badger research control valve 280 maintained a 75 psia back-pressure on the system. A sampling valve 219 located upstream of reactor 230 may allow for sampling of the reaction mixture following mixing of the reactants and prior to their introduction to the packed bed catalytic reactor 230. A bypass valve 221 located downstream of the collection vessel 270 may allow the flow of compressed gas to be vented to the atmosphere. Mass flow controller (MFC) 222 is used to meter make-up gas used to pressurize the head space of the collection vessel, thus it delivers the back pressure for the system. The badger research valve 280 maintains the set-point pressure by releasing this gas to the vent.

Figure 4:
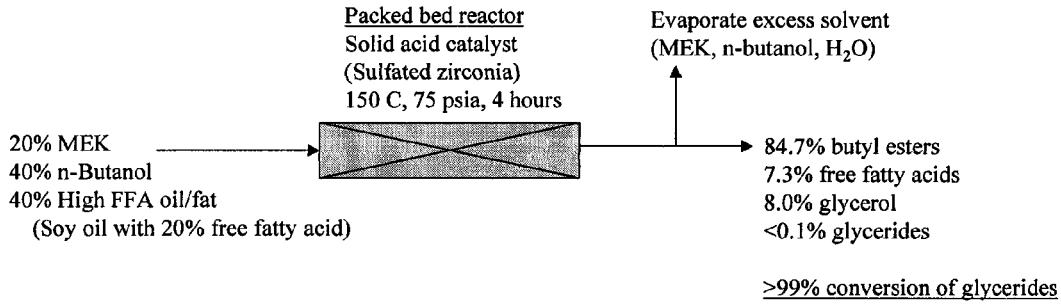
FIGS. 4A and 4B are process flow diagrams for Examples 1A and 1B.
Figure 4:
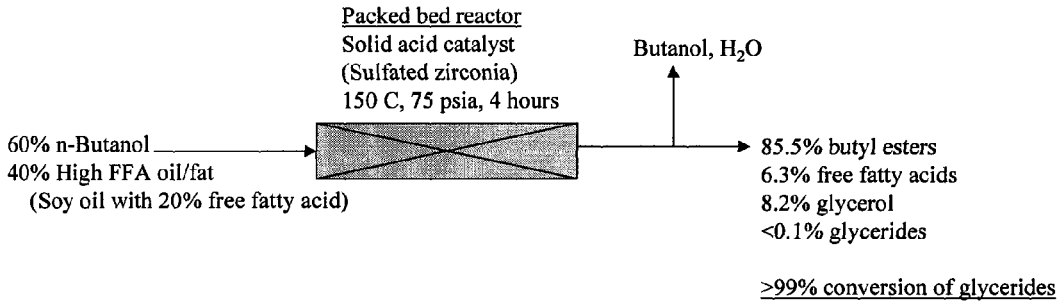

Samples were collected using a 6-port high-pressure sampling valve 255 with 0.5 mL sample loops. Effluent from the packed bed catalytic reactor 230 may enter a cleanout valve 223 before being introduced to the sampling valve 225. The entire system may be coupled to a control box 290 and/or computer 295 that would allow for automation of the process and the receipt, storage, transmittal and display of information from the reactor 200 and its affiliated devices. A similar reactor was used in the upcoming examples and all references made to a reactor design may be considered with regard to FIG. 4.

The entire reaction process is schematized in FIG. 4A. The acid value of the product mixture obtained was determined in accordance with ASTM method D1980-87. The ratio of fatty acid to alkyl ester in the product mixture was determined by gas chromatography. The product mixture was found to contain 84.7% butyl esters (biodiesel), 7.3% fatty acids, 8.0% glycerin, and less than 0.1% glycerides. These results demonstrate that when 20% free fatty acid (linoleic acid) was present and 20% co-solvent (MEK) used, the feed was converted into over 80% biodiesel in a single pass reactor using a solid acid catalyst.

Example 1B

A high free fatty acid feedstock was made by mixing 80% by mass soybean oil (Cargill) and 20% palmitic acid (Aldrich). This feedstock was heated to melt the palmitic acid and loaded into a 260 cc syringe pump 210 (ISCO) with an external heating jacket. A mixture of 66.7% 1-butanol and 33.3% MEK was loaded into a second 260 cc syringe pump 220. The two pumps feed the liquids to a packed bed catalytic reactor 230 made from a hollowed out stainless steel rod with porous metal filters on each end to contain the solid catalyst. The flow rate for the oil feed was set to 6 μL/min and the solvent feed was set to 9 μL/min. Thus, the overall mixed feed contained 40% high fatty acid soybean oil, 40% 1-butanol, and 20% MEK. The reactor 230 was packed with about 6 cc of sulfated zirconia pellets (⅛ in diameter pellets, as delivered with no thermal activation, from Saint Gobain). At this volumetric flow rate the residence time in the reactor 230 was 4 hours. Resistive band heaters on the outside of the stainless steel reactor kept the reactor temperature controlled to 150° C. The exit of the reactor 230 was plumbed into a collection vessel 270 that contained an applied pressure from compressed nitrogen 260. A Badger research control valve 280 maintained a 75 psia back-pressure on the system.

Samples were collected using a 6-port high-pressure sampling valve 255 with 0.5 mL sample loops. The acid value of the product mixture obtained was determined in accordance with ASTM method D1980-87. The ratio of fatty acid to alkyl ester in the product mixture was determined by gas chromatography. The product mixture was found to contain greater than 80% butyl esters (biodiesel), less than 10% fatty acids, and less than 0.1% glycerides. The results demonstrate that when 20% free fatty acid (palmitic acid) was present and 20% co-solvent (MEK) used, the feed was converted into over 80% biodiesel in a single pass reactor using a solid acid catalyst.

Example 1C

A high free fatty acid feedstock was made by mixing 80% by mass soybean oil (Cargill) and 20% linoleic acid (Aldrich). This feedstock was loaded into a 260 cc syringe pump 210 (ISCO). 1-butanol was loaded into a second 260 cc syringe pump 220. The two pumps feed the liquids to a packed bed catalytic reactor 230 made from a hollowed out stainless steel rod with porous metal filters on each end to contain the solid catalyst. The flow rate for the oil feed was set to 6 μL/min and the solvent feed was set to 9 μL/min. Thus, the overall mixed feed contained 40% high fatty acid soybean oil, and 60% 1-butanol. The entire reaction process is schematized in FIG. 4B. The reactor 230 was packed with about 6 cc of sulfated zirconia pellets (⅛ in diameter pellets, as delivered with no thermal activation, from Saint Gobain). At this volumetric flow rate the residence time in the reactor 230 was 4 hours. Resistive band heaters on the outside of the stainless steel reactor kept the reactor temperature controlled to 150° C. The exit of the reactor 230 was plumbed into a collection vessel 270 that contained an applied pressure from compressed nitrogen 260. A Badger research control valve 280 maintained a 75 psia back-pressure on the system.

Samples were collected using a 6-port high-pressure sampling valve 255 with 0.5 mL sample loops. The acid value of the product mixture obtained was determined in accordance with ASTM method D1980-87. The ratio of fatty acid to alkyl ester in the product mixture was determined by gas chromatography. The product mixture was found to contain 85.5% butyl esters (biodiesel), 6.3% fatty acids, 8.2% glycerin and less than 0.1% glycerides. The results demonstrate that when 20% free fatty acids were present, the feed was converted into over 80% biodiesel in a single pass reactor using a solid acid catalyst. The co-solvent in Examples 1A and 1B can be useful when saturated oils, fats, or fatty acids are present, which are solids at room temperature. Using the co-solvent simplified the handling of the materials, but it was not necessary for this example.

Example 2

The use of a refined soybean oil without added free fatty acid was investigated as the feedstock for the production of an alkyl ester composition. The oil syringe pump 210 was set to deliver 5 μL/min of oil, while the solvent pump 220 was set to deliver 10 μL/min of a mixture of 70% MEK and 30% 1-butanol. Thus, the overall feed mixture was 15 μL/min of 33.3% refined soybean oil, 20% butanol and 46.7% MEK. More co-solvent was needed for Example 2 than Examples 1A and 1B to form a single phase because of the absence of excess free fatty acid. The apparatus 200 was operated so that the residence time in the reactor 230 was 4 hours. The reactor 230 contained about 6 cc of sulfated zirconia pellets (⅛ in diameter pellets, as delivered with no thermal activation, from Saint Gobain). The reaction temperature was 150° C. and the pressure was 75 psia. The acid value of the product mixture obtained was determined in accordance with ASTM method D1980-87. The ratio of fatty acid to alkyl ester in the product mixture was determined by gas chromatography. These reaction conditions yielded a product mixture with 16.6% butyl esters (biodiesel), 2.1% fatty acids, 1.8% glycerin and 79.5% glycerides (unreacted feedstock), thus the conversion was much lower than Examples 1A, 1B and 1C. The results show the importance of a high level of free fatty acid to achieve a high conversion of the glyceride fraction in the feed. Without wishing to be limited by theory, the free fatty acids act as a weak surfactant helping to form a single phase between the vegetable oil and butanol (with the addition of some MEK co-solvent).

Example 3

The effect of the addition of 2% water in the reaction feed was investigated. The oil syringe pump 210 was set to deliver 6 μL/min of 20% free fatty acid soybean oil, while the solvent pump 220 was set to deliver 9 μL/min of a mixture of 30.0% MEK, 57.0% 1-butanol, and 3% water. Thus, the overall feed mixture was 15 μL/min of 40% high free fatty acid soybean oil, 38% butanol, 20% MEK, and 2% water. The apparatus 200 was operated so that the residence time in the reactor 230 was 4 hours. The reactor 230 contained about 6 cc of sulfated zirconia pellets (⅛ in diameter pellets, as delivered with no thermal activation, from Saint Gobain). The reaction temperature was 150° C. and the pressure was 75 psia. The acid value of the product mixture obtained was determined in accordance ASTM method D1980-87. The ratio of fatty acid to alkyl ester in the product mixture was determined by gas chromatography. These reaction conditions yielded a product mixture with 82.0% butyl esters (biodiesel), 9.8% fatty acids, 8.2% glycerin, less than 0.1% glycerides (unreacted feedstock). The conversion of glycerides was nearly complete, similar to the results described in Examples 1A-B, but the conversion of fatty acids to alkyl esters was slighter lower than Examples 1A-B. The results demonstrate that de-watering waste oils and fats can increase the fatty acid conversion slightly, but the presence of water does not affect the glyceride splitting/cracking reaction. Furthermore, the results show that adding water lowered the equilibrium conversion. Without wishing to be limited by theory, added water promoted the hydrolysis reaction, but limited the conversion of the simultaneously occurring direct esterification reaction.

Example 4

The effect of the addition of 2% water in the reaction feed without the addition of free fatty acid was investigated. The same reactor hardware in Example 1 was used for this example. The oil syringe pump 210 was set to deliver 6 μL/min of refined soybean oil, while the solvent pump 220 was set to deliver 9 μL/min of a mixture of 30.0% MEK, 57.0% 1-butanol, and 3% water. Thus, the overall feed mixture was 15 μL/min of 40% refined soybean oil, 38% butanol, 20% MEK, and 2% water. The apparatus 200 was operated so that the residence time in the reactor 230 was 4 hours. The reactor 230 contained about 6 cc of sulfated zirconia pellets (⅛ in diameter pellets, as delivered with no thermal activation, from Saint Gobain). The reaction temperature was 150° C. and the pressure was 75 psia. The acid value of the product mixture obtained was determined in accordance with ASTM method D1980-87. The ratio of fatty acid to alkyl ester in the product mixture obtained was determined by gas chromatography. These reaction conditions yielded a product mixture with 19.2% butyl esters (biodiesel), 3.1% fatty acids, 2.2% glycerin and, 75.5% glycerides (unreacted feedstock). The conversion of glycerides was much lower than that described in Examples 1A-B. The results also show the importance of free fatty acid on the conversion of the glyceride feed. In this example no free fatty acid was added to the soybean oil, but 2% water was added instead to promote the hydrolysis reaction to split the glyceride.

Example 5

The effect of reacting the product mixture obtained as previously described in Example 3 with a solid acid catalyst for a second time was investigated. In this example, the product mixture obtained from Example 3 is reacted with ethanol in the presence of a solid acid catalyst. 200 mL of the product from Example 3 was collected. The MEK co-solvent, excess 1-butanol and water was fully evaporated using a roto-evaporator and glycerin was removed by centrifugation, leaving a mixture of about 89.3% butyl esters and 10.7% free fatty acids. This mixture was loaded into the oil syringe pump 210 of the apparatus. The solvent pump 220 was loaded with 100% anhydrous ethanol (Aldrich). The oil syringe pump 210 was set to deliver 6 μL/min of crude biodiesel intermediate, while the alcohol pump 220 was set to deliver 9 μL/min of anhydrous ethanol. Thus the overall feed mixture was 15 μL/min of 40% purified crude biodiesel product from Example 1, and 60% ethanol. The apparatus 200 was operated so that the residence time in the reactor 230 was 4 hours. The reactor 230 contained about 6 cc of AMBERLYST-15 beads (Rohm and Haas). The reaction temperature was 120° C. and the pressure was 65 psia. The acid value of the product mixture obtained was determined in accordance with ASTM method D1980-87. The ratio of fatty acid to alkyl ester in the product mixture was determined by gas chromatography. These reaction conditions yielded a product with greater than 99.4% alkyl esters (biodiesel), and less than 0.6% free fatty acid and demonstrated an increase in the percentage of alkyl esters could be obtained using an second reaction process involving contacting with a solid acid catalyst.

Example 6

The effect of reacting the product mixture obtained as previously described in Example 3 with a solid acid catalyst for a second time was investigated. In this example, the product mixture obtained from Example 3 is reacted again with butanol in the presence of a solid acid catalyst. 200 mL of the product from Example 3 was collected. The MEK co-solvent, excess 1-butanol and water was fully evaporated using a roto-evaporator and glycerin was removed by centrifugation, leaving a mixture of about 89.3% butyl esters and 10.7% free fatty acids. This mixture was loaded into the oil syringe pump 210 of the apparatus 200. The solvent pump 220 was loaded with 100% anhydrous 1-butanol (Aldrich). The oil syringe pump was set to deliver 6 μL/min of refined soybean oil, while the butanol pump was set to deliver 9 μL/min of anhydrous butanol. Thus, the overall feed mixture was 15 μL/min of 40% purified crude biodiesel product from Example 3, and 60% butanol. The apparatus 200 was operated so that the residence time in the reactor 230 was 4 hours. The reactor 230 contained about 6 cc of Amberlyst-15 beads (Rohm and Haas). The reaction temperature was 120° C. and the pressure was 65 psia. The acid value of the product was determined in accordance with ASTM method D1980-87. The ratio of fatty acid to alkyl ester in the product mixture was determined by gas chromatography. These reaction conditions yielded a product mixture with greater than 99.4% butyl esters (biodiesel) and, less than 0.6% free fatty acid.

Example 7

The effect of reacting the product mixture obtained as previously described in Example 3 with a solid acid catalyst for a second time was investigated. In this example, the product mixture obtained from Example 3 is reacted with ethanol in the presence of a solid acid catalyst comprising a nanostructured polymer catalyst. 200 mL of the product from Example 3 was collected. The MEK co-solvent, excess 1-butanol and water was fully evaporated using a roto-evaporator and glycerin was removed by centrifugation, leaving a mixture of about 89.3% butyl esters and 10.7% free fatty acids. This mixture was loaded into the oil syringe pump 210 of the apparatus 200. The solvent pump 220 was loaded with 100% anhydrous ethanol (Aldrich). The oil syringe pump 210 was set to deliver 6 μL/min of refined soybean oil, while the ethanol pump 220 was set to deliver 9 μL/min of anhydrous ethanol. Thus, the overall feed mixture was 15 μL/min of 40% purified crude biodiesel product from Example 3, and 60% ethanol. The apparatus 200 was operated so that the residence time in the reactor 230 was 4 hours. The reactor 230 contained about 6 cc nanostructured polymer acid catalysts made by the methods described by Xu et al. in "Heterogeneous catalyst using a nanostructured strong acid resin based on lyotropic liquid crystals" *Journal of the American Chemical Society,* 126, 1616-1667, 2004 previously incorporated herein. The use of these nanostructured solid acid catalysts for esterification reactions involving fatty acids is further described in U.S. patent application Ser. No. 11/381,924 entitled "Method of Making Alkyl Esters" filed on May 5, 2006 previously incorporated herein by reference. The reaction temperature was 120° C. and the pressure was 65 psia. The acid value of the product mixture obtained was determined in accordance with ASTM method D1980-87. The ratio of fatty acid to alkyl ester in the product mixture was determined by gas chromatography. These reaction conditions yielded a product mixture with greater than 99.4% alkyl esters (biodiesel), and less than 0.6% free fatty acid indicating the use of differing solid acid catalysts in the first and second processing steps afforded a product mixture having a high yield of alkyl esters.

Examples 1A-C, 3 and 4 demonstrate the importance of the free fatty acids for achieving a high conversion of the glycerides (oil or fat) into alkyl ester (biodiesel). The residual free fatty acids can be further processed by direct esterification with additional alcohol into biodiesel using a second processing step, such as in Examples 5, 6 and 7.

While various embodiments have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present disclosure. The discussion of a reference in the disclosure is not an admission that it is prior art to the present disclosure, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A method comprising:

contacting an alcohol, a feed comprising one or more glycerides, water and equal to or greater than 2 wt % of one or more free fatty acids, and a solid acid catalyst in one or more reactors; and recovering from the one or more reactors an effluent comprising equal to or greater than about 75 wt % alkyl ester and equal to or less than about 5 wt % glyceride wherein the reaction in the one or more reactors is carried out at a temperature ranging from 100° C. to 220° C. and a pressure to maintain the reaction components in the liquid state, wherein the solid acid catalyst is sulfated zirconia and the sulfated zirconia catalyst is present in the one or more reactors in an amount of from about 100 to about 3000 g/liter of internal reactor volume and wherein water is present in the feed in an amount from about 1% to equal to or less than about 8% by mass.

2. The method of claim 1 wherein the feed comprises equal to or greater than about 5 wt % free fatty acid.

3. The method of claim 1 wherein the feed comprises equal to or greater than about 10 wt % free fatty acid.

4. The method of claim 1 wherein the feed comprises equal to or greater than about 20 wt % free fatty acid.

5. The method of claim 1 wherein the effluent comprises equal to or greater than about 80 wt % alkyl ester and equal to or less than about 5 wt % glyceride.

6. The method of claim 1 wherein the effluent comprises equal to or greater than about 83 w t% alkyl ester and equal to or less than about 5 wt % glyceride.

7. The method of claim 1 wherein excess alcohol and/or water is present in the effluent, and the effluent composition excluding the excess alcohol and/or water comprises equal to or greater than about 80 wt % alkyl ester and equal to or less than about 5 wt % glyceride.

8. The method of claim 1 wherein excess alcohol and/or water is present in the effluent, and the effluent composition excluding the excess alcohol and/or water comprises equal to or greater than about 83 wt % alkyl ester and equal to or less than about 5 wt % glyceride.

9. The method of claim 1 wherein the effluent comprises equal to or greater than about 80 wt % alkyl ester and equal to or less than about 1 wt % glyceride.

10. The method of claim 1 wherein the effluent comprises equal to or greater than about 83 wt % alkyl ester and equal to or less than about 1 wt % glyceride.

11. The method of claim 1 wherein excess alcohol and/or water is present in the effluent, and the effluent composition excluding the excess alcohol and/or water comprises equal to or greater than about 80 wt % alkyl ester and equal to or less than about 1 wt % glyceride.

12. The method of claim 1 wherein excess alcohol and/or water is present in the effluent, and the effluent composition excluding the excess alcohol and/or water comprises equal to or greater than about 83 wt % alkyl ester and equal to or less than about 1 wt % glyceride.

13. The method of claim 1 wherein the effluent comprises less than about 15 wt % free fatty acid.

14. The method of claim 1 wherein the effluent comprises less than about 10 wt % free fatty acid.

15. The method of claim 1 wherein the effluent comprises less than about 2 wt % glyceride.

16. The method of claim 1 wherein the effluent comprises less than about 1 wt % glyceride.

17. The method of claim 1 wherein the reaction temperature range is in a range of from about 150° C. to about 200° C.

18. The method of claim 1 wherein the reaction temperature is in a range of from about 145° C. to about 175° C.

19. The method of claim 1 wherein the reaction temperature is in a range of from about 175° C. to about 200° C.

20. The method of claim 1 wherein the reaction temperature is about 150° C.

21. The method of claim 1 wherein the reaction pressure is in a range of from about 75 psia to about 200 psia.

22. The method of claim 1 wherein the feed comprises corn oil, soybean oil, cuphea oil, peanut oil, radish oil, rice bran oil, rapeseed oil, olive oil, cottonseed oil, sunflower oil, sesame oil, safflower oil, mustard oil, palm oil, coconut oil, jatropha oil, linseed oil, caster oil, evening primrose oil, borage oil, carboseed oil, false flax oil, hemp oil, ramtil oil, tung oil, copaiba oil, hong oil, colza oil, milk bush oil, petroleum nut oil, algal oil, fish oil, lard, tallow, yellow grease, brown grease, waste oil products, acidulated soap stock, meat rendering waste oil, recycled cooking oil, or combinations thereof.

23. The method of claim 1 wherein the alcohol comprises butanol, propanol, ethanol, methanol, or combinations thereof.

24. The method of claim 1 wherein the reaction is carried out in the presence of a ketone co-solvent.

25. The method of claim 24 wherein the ketone comprises 2-butanone.

26. The method of claim 1 carried out in a first reactor and further comprising removing all or a portion of water present in the effluent of the first reactor to provide a dried effluent.

27. The method of claim 26 further comprising contacting an alcohol, the dried effluent of the first reactor, and a solid acid catalyst in a second reactor; and recovering from the second reactor a second effluent comprising equal to or less than about 2 wt % free fatty acid and equal to or less than about 2 wt % glyceride.

28. The method of claim 27 wherein the reaction temperature in the second reactor ranges from about 80° C. to about 150° C.

29. The method of claim 27 wherein the reaction temperature in the second reactor ranges from about 100° C. to about 120° C.

30. The method of claim 1 wherein the concentration of the sulfated zirconia catalyst is from 200 g/liter to 3000 g/liter internal reactor volume.

31. The method of claim 1 wherein the concentration of the sulfated zirconia catalyst is from 500 g/liter to 2500 g/liter internal reactor volume.

32. The method of claim 1 wherein the sulfated zirconia is not in a thermally activated state.

33. The method of claim 1 wherein the glyceride comprises triglyceride.

34. The method of claim 1 wherein the water is present in the feed in an amount from about 1% to equal to or less than about 4% by mass.

35. The method of claim 1 wherein the residence time in a reactor of the one or more reactors ranges from 5 minutes to 5 hours.

36. The method of claim 1 wherein the residence time in a reactor of the one or more reactors ranges from 30 minutes to 4 hours.

37. The method of claim 1 wherein the feed comprises yellow grease, brown grease, waste oil products, acidulated soap stock, meat rendering waste oil, recycled cooking oil or combinations thereof.

38. The method of claim 1 wherein the alcohol comprises ethanol, methanol, or combinations thereof.

39. The method of claim 1 wherein the alcohol contacted with the feed is present in an amount in excess of the ester bond equivalents of the glycerides in the feed and ranges from about 1.0 to about 10.0 excess equivalents.

40. The method of claim 1 wherein the alcohol contacted with the feed is present in an amount in excess of the ester bond equivalents of the glycerides in the feed and ranges from about 1.0 to about 4.0 excess equivalents.

41. The method of claim 1 wherein the feed comprises from about 1% to about 4% by mass water and equal to or greater than about 5 wt % free fatty acid, wherein the residence time in one of the one or more reactors ranges from 5 minutes to 5 hours, wherein the reaction temperature is in a range of from about 145° C. to about 175° C., and wherein the alcohol contacted with the feed is present in an amount in excess of the ester bond equivalents of the glycerides in the feed and ranges from about 1.0 to about 10.0 excess equivalents.

42. The method of claim 41 wherein the feed comprises equal to or greater than about 10 wt % free fatty acid.

43. The method of claim 41 wherein the residence time in a reactor of the one or more reactors ranges from 30 minutes to 4 hours.

44. The method of claim 41 wherein the alcohol contacted with the feed is present in an amount in excess of the ester bond equivalents of the glycerides in the feed and ranges from about 1.0 to about 4.0 excess equivalents.

45. The method of claim 41 wherein the sulfated zirconia is not in a thermally activated state.

46. The method of claim 27 wherein the solid acid catalyst in the second reactor is sulfated zirconia.

* * * * *